US012279692B2

(12) United States Patent
Stewart

(10) Patent No.: US 12,279,692 B2
(45) Date of Patent: Apr. 22, 2025

(54) FURNITURE BASE STRUCTURE

(71) Applicant: Scott Stewart, Milwaukie, OR (US)

(72) Inventor: Scott Stewart, Milwaukie, OR (US)

( * ) Notice: Subject to any disclaimer, the term of this patent is extended or adjusted under 35 U.S.C. 154(b) by 80 days.

(21) Appl. No.: 18/190,834

(22) Filed: Mar. 27, 2023

(65) Prior Publication Data

US 2023/0320481 A1 Oct. 12, 2023

Related U.S. Application Data

(60) Provisional application No. 63/324,543, filed on Mar. 28, 2022.

(51) Int. Cl.
*A47B 3/06* (2006.01)

(52) U.S. Cl.
CPC ..... *A47B 3/06* (2013.01)

(58) Field of Classification Search
CPC ... A47B 3/06; A47B 13/02; A47B 2200/0011; A47B 3/00
See application file for complete search history.

(56) References Cited

U.S. PATENT DOCUMENTS 1,951,619 A * 3/1934 Macdonald ..... A47B 83/02 297/440.13
1,977,848 A * 10/1934 Gwynn ..... A47B 3/02 108/159.12
2,271,496 A * 1/1942 Hofman ..... A47B 13/04 297/440.13
3,396,933 A * 8/1968 Ward ..... A47B 13/04 297/440.13
4,824,058 A * 4/1989 Glendinning ..... A47B 7/00 248/164
5,102,077 A * 4/1992 Glendinning ..... A47B 13/02 248/164
8,418,982 B1 * 4/2013 Vatus ..... A47B 13/02 248/188.7
10,610,011 B1 * 4/2020 Greenhill ..... A47B 23/042
11,064,805 B1 * 7/2021 Berkin-Harper ..... A47B 13/04
2002/0084389 A1 * 7/2002 Larson ..... A47B 21/00 248/371
2007/0256614 A1 * 11/2007 Chen ..... B65D 19/0069 108/153.1
2017/0354243 A1 * 12/2017 Egerhazy ..... A47F 5/16

FOREIGN PATENT DOCUMENTS

FR 2766341 A1 * 1/1999 ..... A47B 13/04
GB 2279867 A * 1/1995 ..... A47B 13/04

* cited by examiner

*Primary Examiner* — Hanh V Tran
(74) *Attorney, Agent, or Firm* — Klarquist Sparkman, LLP

(57) ABSTRACT

A base for support of a rigid surface, assembled from a plurality of elongated beams shaped to meet at contiguous angles connecting the beams so as to form a structure with pentagonal topology. The base can include at least a first beam, second beam, third beam, fourth beam, fifth beam, and sixth beam joined to form the base structure.

22 Claims, 7 Drawing Sheets

FURNITURE BASE STRUCTURE

CROSS REFERENCE TO RELATED APPLICATION

This application claims the benefit of U.S. Provisional Application No. 63/324,543, filed Mar. 28, 2022. The prior application is incorporated herein by reference in its entirety.

FIELD

The present application generally relates to furniture. More particularly, the present application relates to a base for knockdown furniture.

BACKGROUND

Bases for knockdown tables can comprise a plurality of cantilevered beams and mechanical fasteners. However, cantilevered beams can be minimally supported against rotational torque. Also, the cantilevered portions of the beams can lack connections to adjacent beams that aid in stability, rigidity, and strength. These deficiencies can cause the knockdown table base to collapse. Furthermore, the mechanical fasteners can cause wear at joints between the beams over time and can require tools to install. Thus, there exists a need for a sturdier base that can be assembled without tools.

SUMMARY

The present application discloses a base for a knockdown table in accordance with certain examples of the invention that can solve one or more deficiencies in the prior art. In particular, the base can comprise interlocking beams configured to support a rigid horizontal surface. The base can further comprise magnetic fasteners that can secure the plurality of interlocking beams without the use of tools.

In a representative example, a base can comprise a first beam and a second beam that can be configured to define a cross half-lap joint with the first beam, wherein the cross half-lap joint can bisect the first beam and bisects the second beam. The base can further comprise a third beam that can be configured to define a first compound lap joint with the first beam. The base can further comprise a fourth beam that can be configured to define a second compound lap joint with the second beam and can be configured to define a first compound miter joint with the third beam. The base can further comprise a fifth beam that can be configured to define a third compound lap joint with the fourth beam and can be configured to define a second compound miter joint with the first beam. The base can further comprise a sixth beam that can be configured to define a fourth compound lap joint with the third beam. The sixth beam can further be configured to define a fifth compound lap joint with the fifth beam and can be configured to define a third compound miter joint with the second beam.

In another representative example, a base can comprise a first beam, a second beam configured to slidably connect at a first angle to the first beam, a third beam configured to slidably connect at a second angle to the first beam, a fourth beam configured to slidably connect at a third angle to the second beam, a fifth beam configured to slidably connect at a fourth angle to the fourth beam, and a sixth beam configured to slidably connect at a fifth angle to the third beam and slidably connect at a sixth angle to the fifth beam.

In another representative example, a base can comprise a cross half-lap joint formed by a first beam and a second beam, a first compound edge lap joint formed by the first beam and a third beam, a second compound edge lap joint formed by the second beam and a fourth beam, a third compound edge lap joint formed by the fourth beam and a fifth beam, a fourth compound edge lap joint formed by the third beam and a sixth beam, a fifth compound edge lap joint formed by the fifth beam and the sixth beam, a first compound miter joint formed by the first beam and the fifth beam, a second compound miter joint formed by the second beam and the sixth beam, and a third compound miter joint formed by the third beam and the fourth beam.

In another representative example, a base can comprise a plurality of interlocking beams, wherein each of the plurality of interlocking beams is configured to contact three adjacent beams.

In a representative example, a method of assembling a base can comprise mating a first beam and a second beam in an X-shape, slidably connecting a third beam to the first beam. slidably connecting a fourth beam to the second beam, slidably connecting a fifth beam to the fourth beam, connecting the fourth beam to the third beam with magnetic fasteners, slidably connecting a fifth beam to the fourth beam, connecting the fifth beam to the first beam with magnetic fasteners, slidably connecting a sixth beam to the third beam and the fifth beam, and connecting the sixth beam to the second beam with magnetic fasteners.

The foregoing and other objects, features, and advantages of the invention will become more apparent from the following detailed description, which proceeds with reference to the accompanying figures.

DETAILED DESCRIPTION

General Considerations

For purposes of this description, certain aspects, advantages, and novel features of examples of this disclosure are described herein. The disclosed methods, apparatus, and systems should not be construed as being limiting in any way. Instead, the present disclosure is directed toward all novel and nonobvious features and aspects of the various disclosed examples, alone and in various combinations and sub-combinations with one another. The methods, apparatus, and systems are not limited to any specific aspect or feature or combination thereof, nor do the disclosed examples require that any one or more specific advantages be present or problems be solved.

Although the operations of some of the disclosed examples are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

As used in this application and in the claims, the singular forms "a," "an," and "the" include the plural forms unless the context clearly dictates otherwise. Additionally, the term "includes" means "comprises." Further, the term "coupled" generally means physically, mechanically, chemically, magnetically, and/or electrically coupled or linked and does not exclude the presence of intermediate elements between the coupled or associated items absent specific contrary language.

As used in this application and in the claims, the term "topology" refers to a horizontal cross-section of a base or other structure. For example, a base with a "pentagonal topology" can refer to a structure with a horizontal cross section shaped like a five-pointed star.

Examples of the Disclosed Technology

Figure 1:
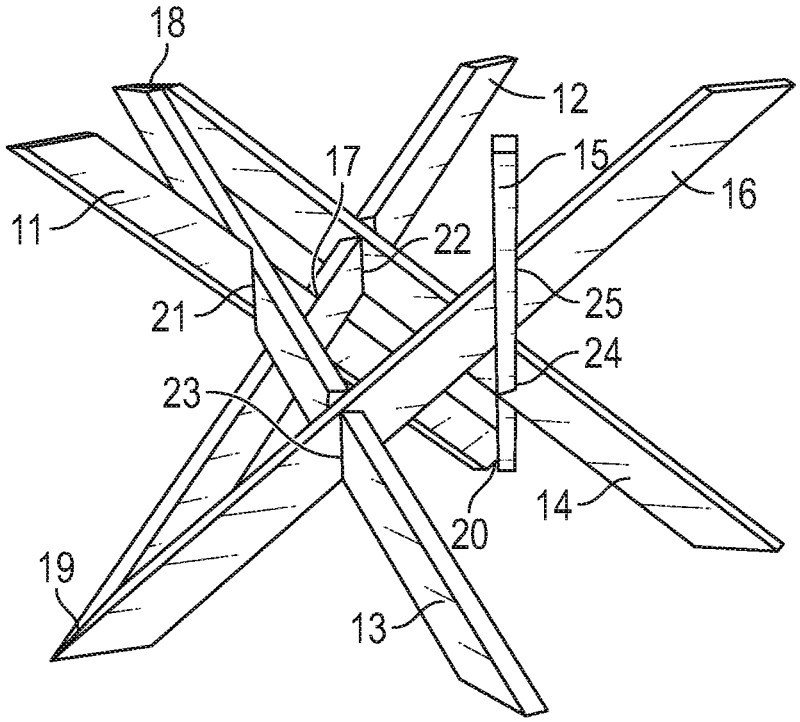
FIG. 1 is a perspective view from the left rear side of a base, according to one example.

FIG. 1 is a perspective view taken from the left rear side of a base, according to one example of the invention. The base can comprise rigid beams 11, 12, 13, 14, 15, and 16. Each beam can be equal in length, width, and thickness. Beams can be connected at contiguous intersections by means of interlocked knockdown joinery 17, 18, 19, 20, 21, 22, 23, 24, and 25. Each beam can be joined to three adjacent contiguous beams, e.g., beam 11 can connect with beam 12 at joint 17, with beam 13 at joint 21, and with beam 15 at joint 20. There can be three types of knockdown joinery employed in this iteration:

First, joint 17 can connect beam 11 and beam 12 in a single vertical plane forming an equilateral 'X' shape with rigid fixed angles between beams.

Second, joint 18, 19, and 20 can connect beams 13 and 14, beams 12 and 16, and beams 11 and 15, respectively. These joints can be employed at the termination between beams and forming a rigid 'V' shape topology at angles corresponding to pentagonal topology. Magnetic fasteners (hidden in this view) can add strength and stability to joint 18, 19, and 20, (FIG. 6).

Figure 5:
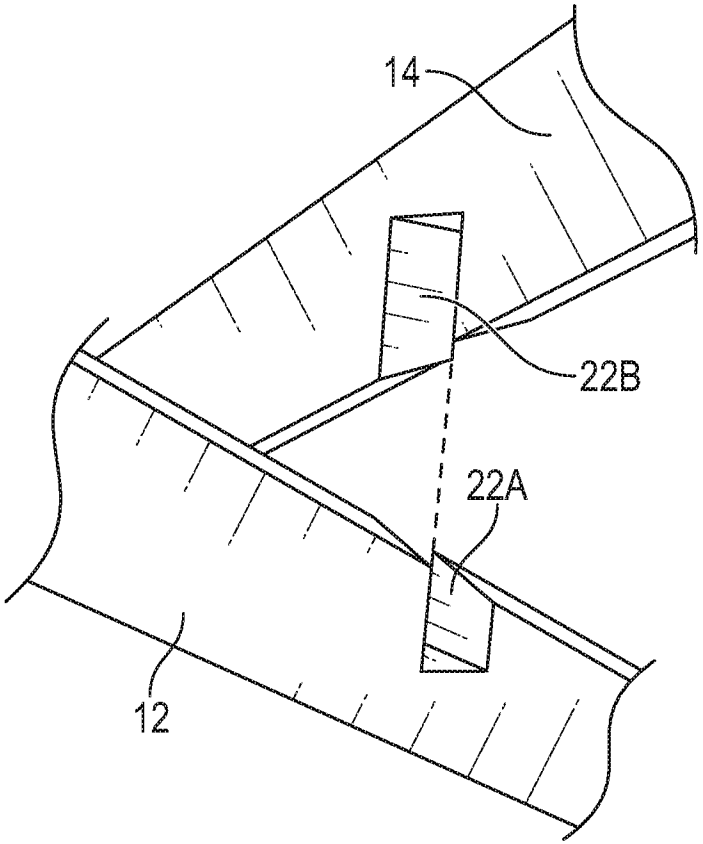
FIG. 5 is an exploded perspective detail view of angled cutouts shaped to slidably mate joining beams at compound angles, according to one example.

Third, joint 21, 22, 23, 24, and 25 can connect contiguous beams at compound angles corresponding with pentagonal topology. Joints can be shaped with cutouts in beams allowing slidable contact between all mated contiguous surfaces, e.g., joint 22 can support the junction between beam 12 and beam 14, (FIG. 5).

In this iteration no permanent bonding between beams is employed which allows for moving, assembly, and disassembly as desired. Further, no tools are required for assembly or disassembly.

Figure 2:
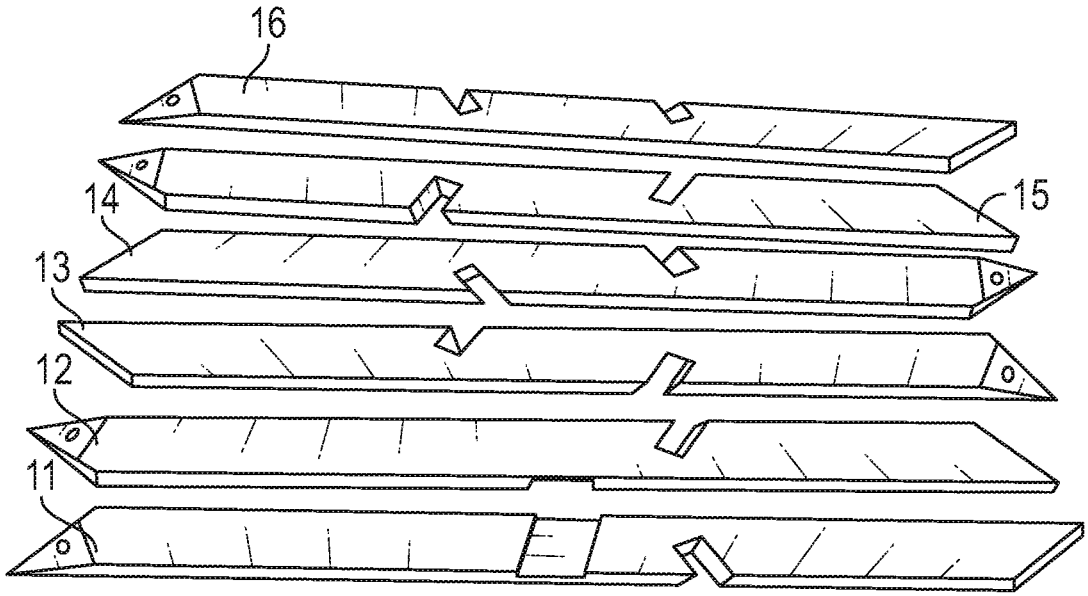
FIG. 2 is a perspective view of a disassembled base, according to one example.
Figure 6:
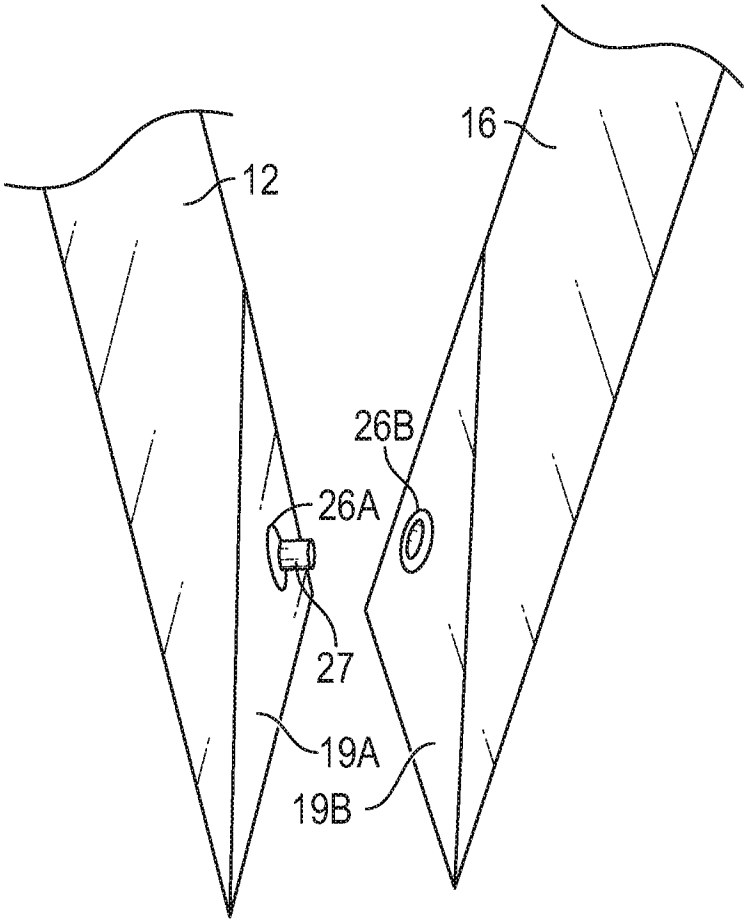
FIG. 6 is an exploded perspective detail view of inlaid magnetic fasteners used to stabilize joints at mated termination of beams, according to one example.

FIG. 2 is a perspective view of the base of FIG. 1 showing beam 11, 12, 13, 14, 15, and 16 disassembled with magnetic fasteners from terminations at joint 18, 19, and 20 facing upward, (FIG. 6, magnetic fastener detail). Each beam can comprise an opposite end termination which is cantilevered upon assembly, shaped to support a horizontal rigid surface. Beam 11 and 12 can comprise centered angled cutouts shaped to slidably connect at joint 17, and compound angled cutouts aligned with pentagonal topology mated to slidably connect with beam 13 and 14, forming joint 21 and 22 respectively. Beam 13, 14, 15, and 16 can each comprise two cutouts shaped to slidably mate with contiguous beams following pentagonal topology. Each of these cutouts are equivalent to those forming joint 21 and 22, shaped to form joint 23, 24, and 25 (detail FIG. 5).

Figure 3:
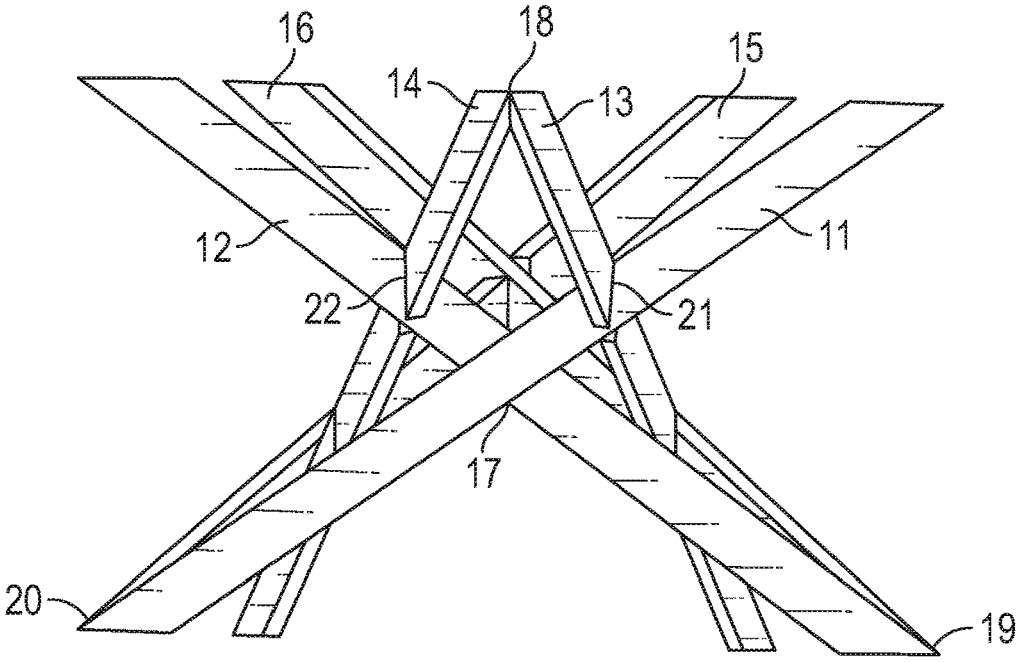
FIG. 3 is a perspective front view of the base, according to one example.

FIG. 3 is a perspective front view of the base of FIG. 1 showing the rigid 'X' shape that can be formed by beam 11 and 12 when equivalently aligned at joint 17. In this iteration the angle between beam 11 and 12 established at joint 17 can be the same for beam 13, 14, 15, and 16 forming pentagonal topology.

Beams 11, 12, 13, 14, 15, and 16 can be further shaped to terminate on parallel horizontal planes providing support for a rigid horizontal load (not shown). The contiguous nature of beams is apparent at joint 17, 18, 19, 20, 21, and 22.

Figure 4:
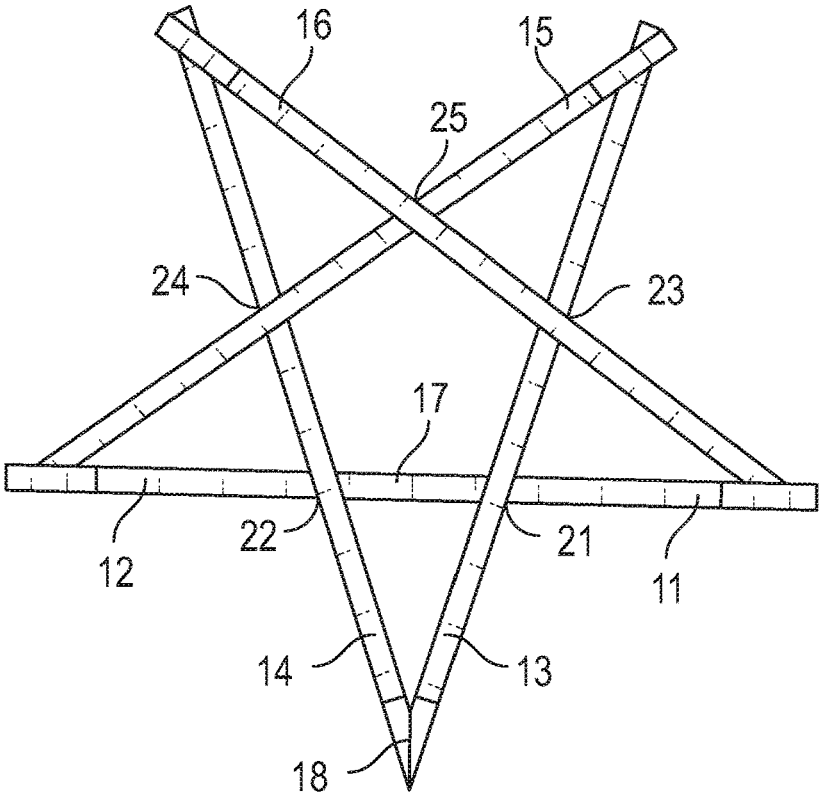
FIG. 4 is a perspective top view of the support base, according to one example.

FIG. 4 is a perspective top view of the base of FIG. 1 showing pentagonal topology between beam 11, 12, 13, 14, 15, and 16 as joined. Beam 11 and 12 can be connected in a single vertical plane at joint 17. Beam 13 and 14 can intersect at joint 18, (joint 19 and 20 connect beams 12 and 16, and 11 and 15, respectively, hidden in this view). Joint 21, 22, 23, 24, and 25 can slidably connect contiguous beams to form the base. Each beam can comprise one joined terminal end forming a 'V' joint, e.g., joint 18 connecting beam 13 and 14 forming a 'V' topology, with opposing terminal ends of each beam cantilevered.

FIG. 5 is an exploded perspective detail view of beam 12 and 14 showing shaped slidable joinery forming joint 22 as employed in this iteration (equivalent joinery is employed between contiguous beams of FIG. 1 at joint 21, 23, 24, and 25). Compound angled cutouts 22A and 22B can slidably connect beam 12 and 14 at angles corresponding to FIG. 3. And FIG. 4. Each cutout forms a compound angled slot shaped to form material surfaces joining of contiguous beams along slidable planes.

FIG. 6 is a detailed exploded perspective view of magnetic fastener employed to strengthen each 'V' joint as in FIG. 3 and FIG. 4. Shown is the terminal end of beam 12 and beam 16 with mated surface 19A and 19B which connect to form joint 19. Ring magnet 26A and steel pin 27 are shown inlaid into beam 12 perpendicular to surface 19A. Ring magnet 26B is of opposite polarity, inlaid and aligned into beam 16 perpendicular to surface 19B. As the joint is assembled a small force may be applied inside and opposite each beam allowing clearance between pin 27 and surface 19B. As alignment occurs between magnets, natural forces act to align and join pin 27 into the open ring portion of magnet 26B. Contact is then made between the face of magnet 26A and 26B, completing the joint and providing strength and stability to the base as loads are applied. Joint 18 and joint 20 are equivalently fastened joining beam 13 and 14, and beam 11 and 15, respectively.

Figure 7:
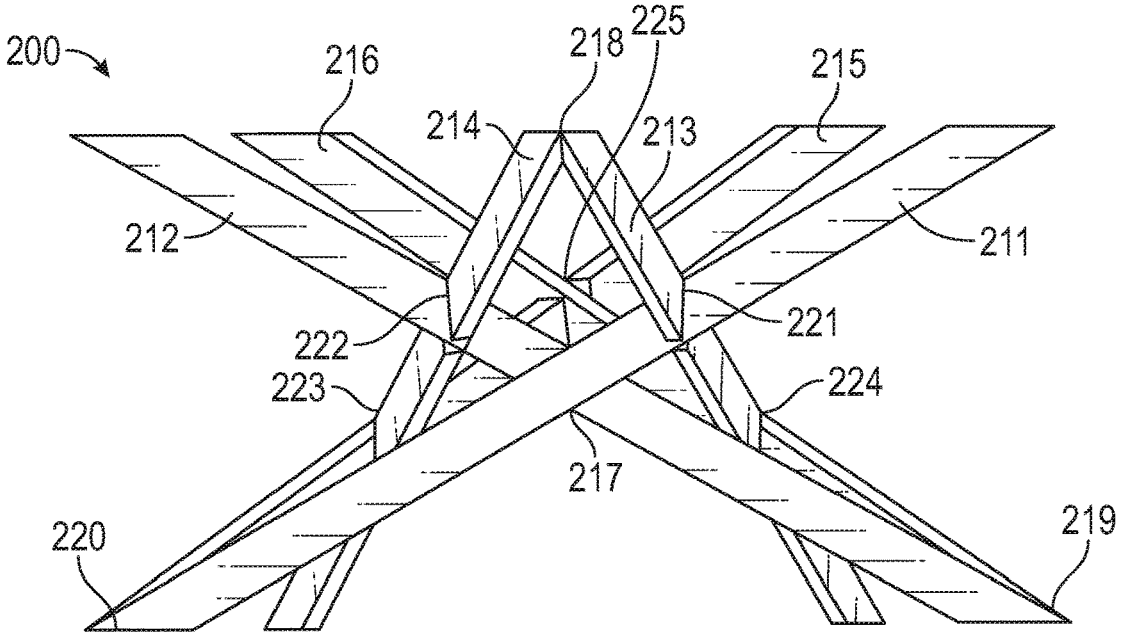
FIG. 7 is a perspective front view of a base, according to another example.

FIG. 7 is a perspective front view of a base 200, according to another example. The base 200 can comprise a first beam 211, a second beam 212, a third beam 213, a fourth beam 214, a fifth beam 215, and a sixth beam 216. However, other examples of the base 200 can comprise additional or alternative components.

The first beam 211 can comprise a beam extending between a first upper end portion and a first lower end portion. The first upper end portion can be disposed towards an upper portion of the base 200 and can comprise an angled cut. Likewise, the first lower end portion can be disposed towards a lower portion of the base 200 and can comprise an angled cut. A first intermediate portion can be disposed between the first upper end portion and the first lower end portion.

The second beam 212 can comprise a beam extending between a second upper end portion and a second lower end portion. The second upper end portion can be disposed towards an upper portion of the base 200, while the second lower end portion can be disposed towards a lower portion of the base 200. A second intermediate portion can be disposed between the second upper end portion and the second lower end portion.

The first beam 211 and the second beam 212 can be mated to define a cross half-lap joint 217. The cross half-lap joint 217 can be formed by mating a first half lap disposed on the first intermediate portion with a second half-lap disposed on the second intermediate portion. In some examples, the cross half-lap joint 217 can bisect the first beam 211 and the second beam 212. In the illustrated example, the first beam 211 and the second beam 212 can be mated at a non-right angle to increase a width of the base 200 or decrease a height of the base 200. However, different examples of the base 200 can feature a different angle between the first beam 211 and the second beam 212 to vary the width or the height of the base 200.

The third beam 213 can comprise a beam extending between a third upper end portion and a third lower end portion. The third upper end portion can be disposed towards an upper portion of the base 200, while the third lower end portion can be disposed towards a lower portion of the base 200. A third intermediate portion can be disposed between the third upper end portion and the third lower end portion.

The first beam 211 and the third beam 213 can be slidably connected to define a first compound edge lap joint 221. The first compound edge lap joint 221 can be formed by mating an edge cutout disposed on the first intermediate portion with a complementary edge cutout disposed on the third intermediate portion.

In some examples, the first beam 211 and the third beam 213 can be joined at the first compound edge lap joint 221 without the use of fasteners, adhesives, or other connectors, thereby allowing the base 200 to be assembled and/or knocked down without the use of tools.

The fourth beam 214 can comprise a beam extending between a fourth upper end portion and a fourth lower end portion. The fourth upper end portion can be disposed towards an upper portion of the base 200, while the fourth lower end portion can be disposed towards a lower portion of the base 200. A fourth intermediate portion can be disposed between the fourth upper end portion and the fourth lower end portion.

The second beam 212 and the fourth beam 214 can be slidably connected to define a second compound edge lap joint 222. The second compound edge lap joint 222 can be formed by mating an edge cutout disposed on the second intermediate portion with a complementary edge cutout disposed on the fourth intermediate portion.

In some examples, the second beam 212 and the fourth beam 214 can be joined at the second compound edge lap joint 222 without the use of fasteners, adhesives, or other connectors, thereby allowing the base 200 to be assembled and/or knocked down without the use of tools.

The fifth beam 215 can comprise a beam extending between a fifth upper end portion and a fifth lower end portion. The fifth upper end portion can be disposed towards an upper portion of the base 200, while the fifth lower end portion can be disposed towards a lower portion of the base 200. A fifth intermediate portion can be disposed between the fifth upper end portion and the fifth lower end portion.

The fourth beam 214 and the fifth beam 215 can be slidably connected to define a third compound edge lap joint 223. The third compound edge lap joint 223 can be formed by mating an edge cutout disposed on the fourth intermediate portion with a complementary edge cutout disposed on the fifth intermediate portion.

In some examples, the fourth beam 214 and the fifth beam 215 can be joined at the third compound edge lap joint 223 without the use of fasteners, adhesives, or other connectors, thereby allowing the base 200 to be assembled and/or knocked down without the use of tools.

The sixth beam 216 can comprise a beam extending between a sixth upper end portion and a sixth lower end portion. The sixth upper end portion can be disposed towards an upper portion of the base 200, while the sixth lower end portion can be disposed towards a lower portion of the base 200. A sixth intermediate portion can be disposed between the sixth upper end portion and the sixth lower end portion.

The third beam 213 and the sixth beam 216 can be slidably connected to define a fourth compound edge lap joint 224. The fourth compound edge lap joint 224 can be formed by mating an edge cutout disposed on the third intermediate portion with a complementary edge cutout disposed on the sixth intermediate portion.

In some examples, the third beam 213 and the sixth beam 216 can be joined at the fourth compound edge lap joint 224 without the use of fasteners, adhesives, or other connectors, thereby allowing the base 200 to be assembled and/or knocked down without the use of tools.

The fifth beam 215 and the sixth beam 216 can be connected to define a fifth compound edge lap joint 225. The fifth compound edge lap joint 225 can be formed by mating an edge cutout disposed on the fifth intermediate portion with a complementary edge cutout disposed on the sixth intermediate portion.

In some examples, the fifth beam 215 and the sixth beam 216 can be joined at the fifth compound edge lap joint 225 without the use of fasteners, adhesives, or other connectors, thereby allowing the base 200 to be assembled and/or knocked down without the use of tools.

The third beam 213 and the fourth beam 214 can be connected to define a first compound miter joint 218. The first compound miter joint 218 can be formed by mating a mitered cut disposed on the third upper end portion with a complementary mitered cut disposed on the fourth upper end portion.

The second beam 212 and the sixth beam 216 can be slidably connected to define a second compound miter joint 219. The second compound miter joint 219 can be formed by mating a mitered cut disposed on the second lower end portion with a complementary mitered cut disposed on the sixth lower end portion.

The first beam 211 and the fifth beam 215 can be slidably connected to define a third compound miter joint 220. The third compound miter joint 220 can be formed by mating a mitered cut disposed on the first lower end portion with a complementary mitered cut disposed on the fifth lower end portion.

In some examples, the upper end portions of the first beam 211, the second beam 212, the third beam 213, the fourth beam 214, the fifth beam 215, and the sixth beam 216 can be cut at an angle to horizontally support a rigid surface.

In some examples, the lower end portions of the first beam 211, the second beam 212, the third beam 213, the fourth beam 214, the fifth beam 215, and the sixth beam 216 can be cut at an angle such that the entire cross section of the beam contacts a ground surface upon which the base 200 rests.

Figure 8:
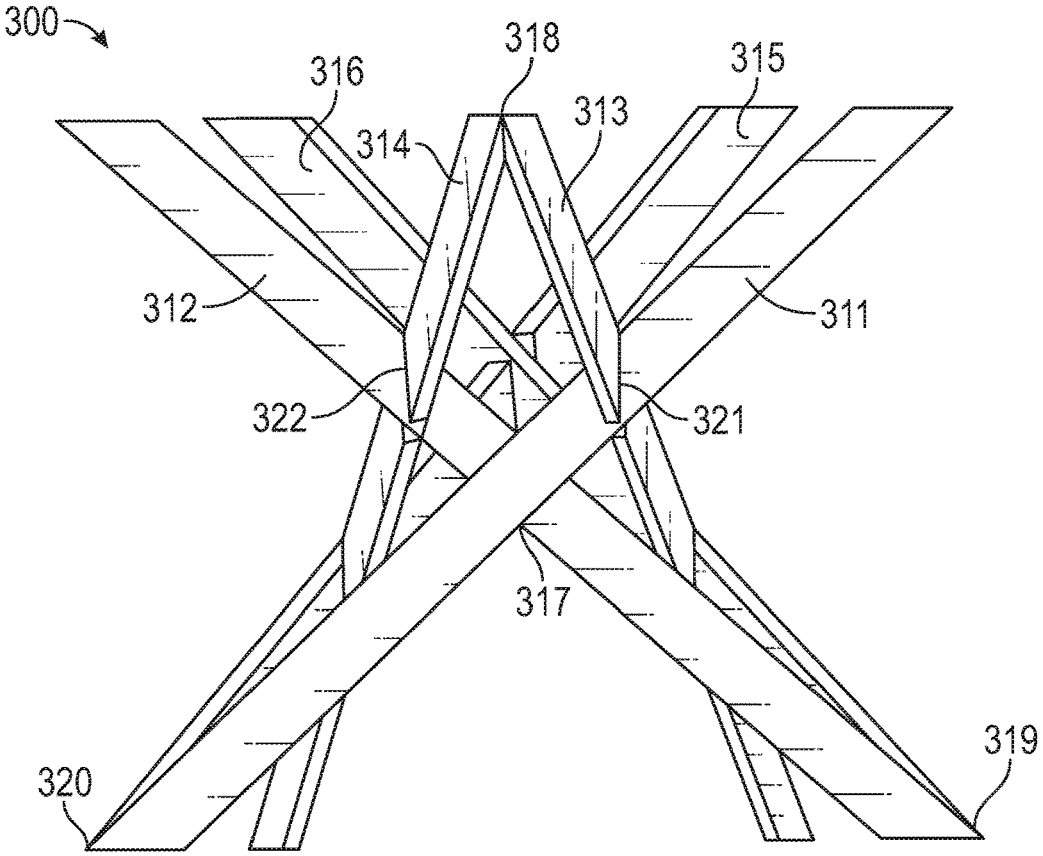
FIG. 8 is a perspective front view of a base, according to another example.

FIG. 8 is a perspective front view of a base 300, according to another example. As compared to the base 200 illustrated in FIG. 7, the base 300 in FIG. 8 can have a taller height and a narrower width. In the illustrated example, a first beam 311 and a second beam 312 can be mated at a right angle at a cross half-lap joint 317. However, as illustrated in other examples, the first beam 311 and the second beam 312 can form a non-right angle at the cross half-lap joint 317.

Figure 9:
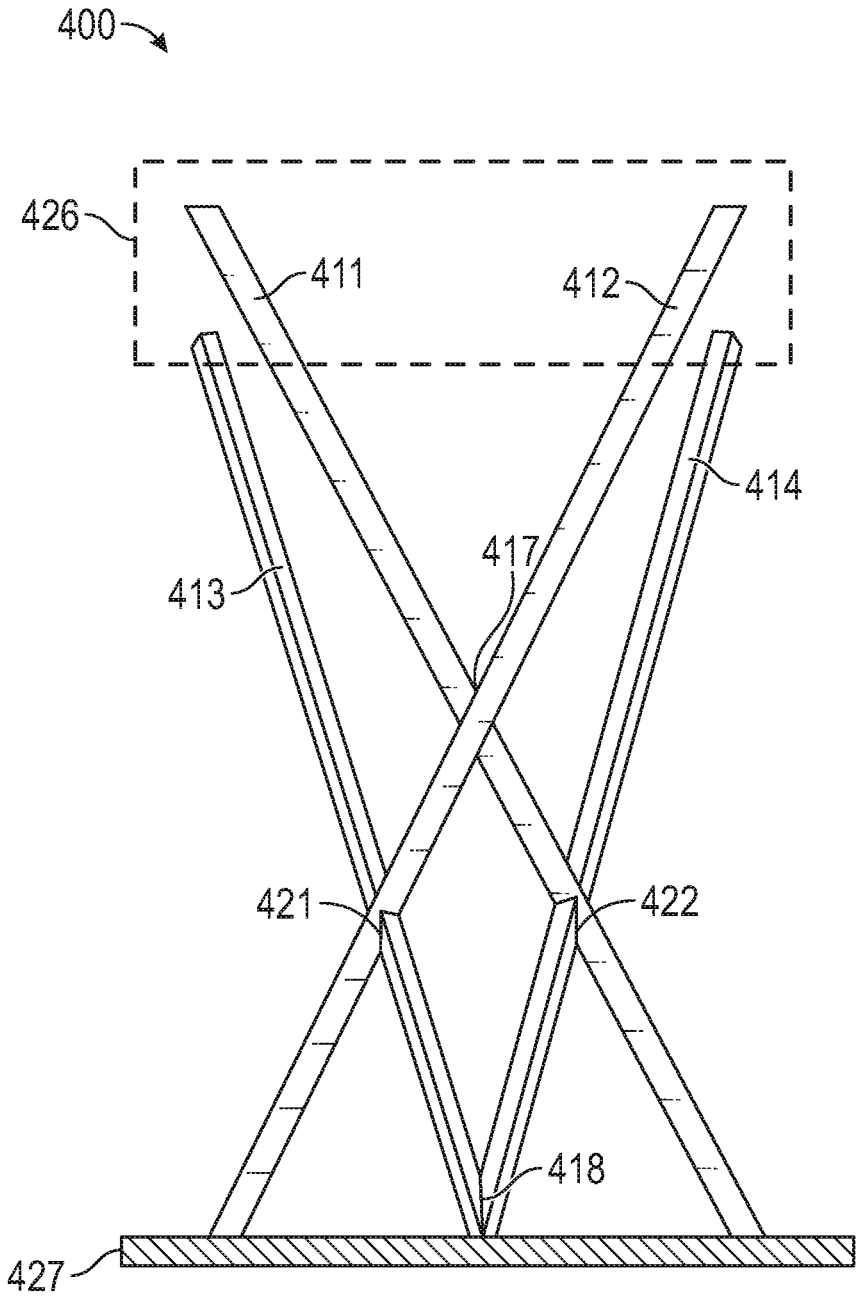
FIG. 9 is a perspective front view of a base in a lectern configuration, according to one example.
Figure 10:
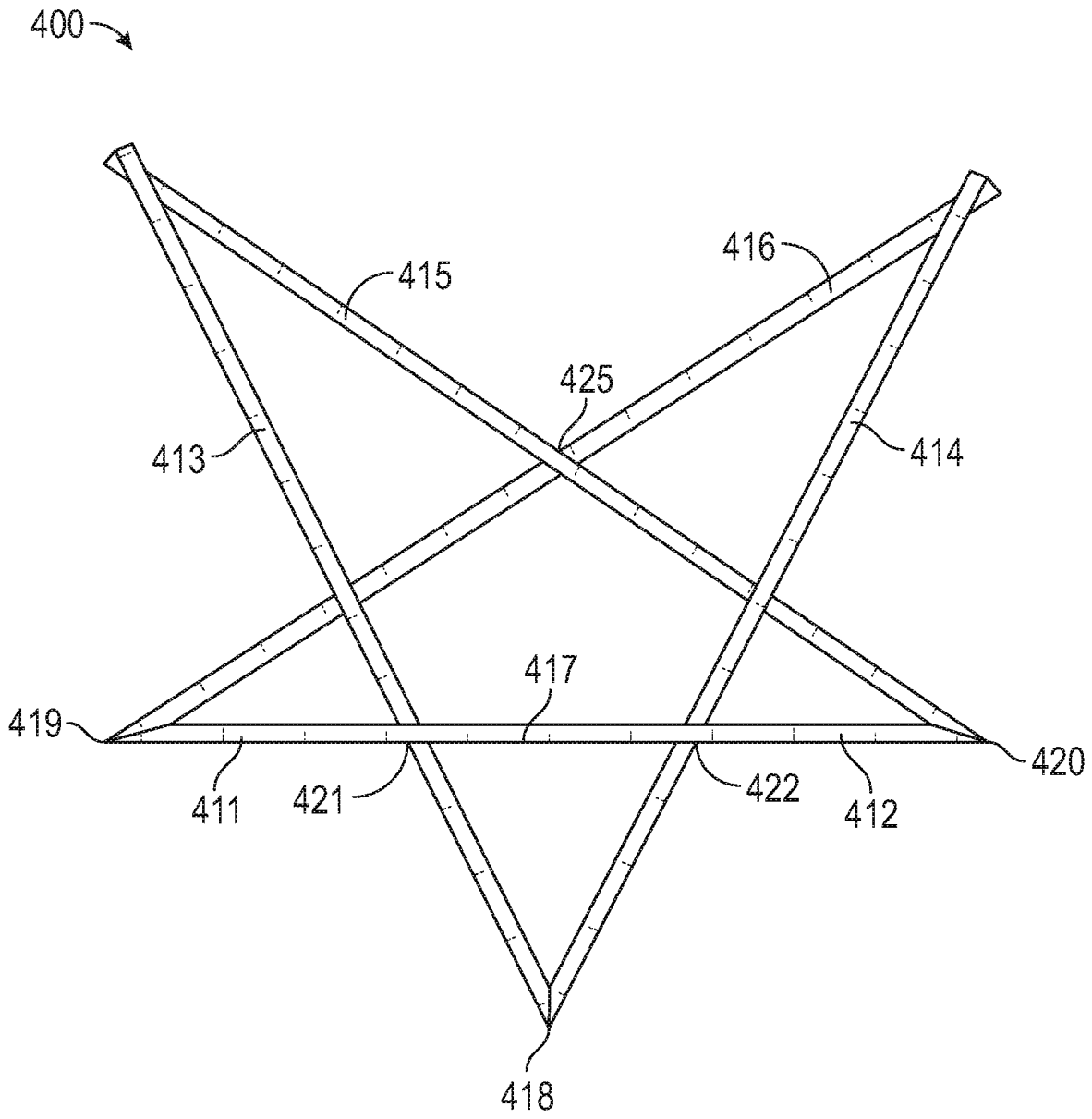
FIG. 10 is a perspective top view of the base in the lectern configuration, according to one example.

FIGS. 9-10 illustrate a base 400 in a lectern configuration, according to another example. The base 400 can comprise a first beam 411, a second beam 412, a third beam 413, a fourth beam 414, a fifth beam 415, a sixth beam 416 configured to interlock in a pentagonal topology. The base 400 can further comprise a lectern surface 426, which can alternatively be referred to as an angled rigid surface. However, other examples of the base 400 can comprise additional or alternative components.

The third beam 413 can be configured to slidably mate to the first beam 411 to form a first compound edge lap joint 421. The third beam 413 can be mated to the fourth beam 414 to form a first compound miter joint 418. However, the third beam 413 is not configured to mate to the sixth beam 416 in the lectern configuration.

The fourth beam 414 can be configured to slidably mate to the second beam 412 to form a second compound edge lap joint 422 and, as previously described, can be mated to the third beam 413 to form the first compound miter joint 418. However, the fourth beam 414 is not configured to mate to the fifth beam 415 in the lectern configuration.

Figure 11:
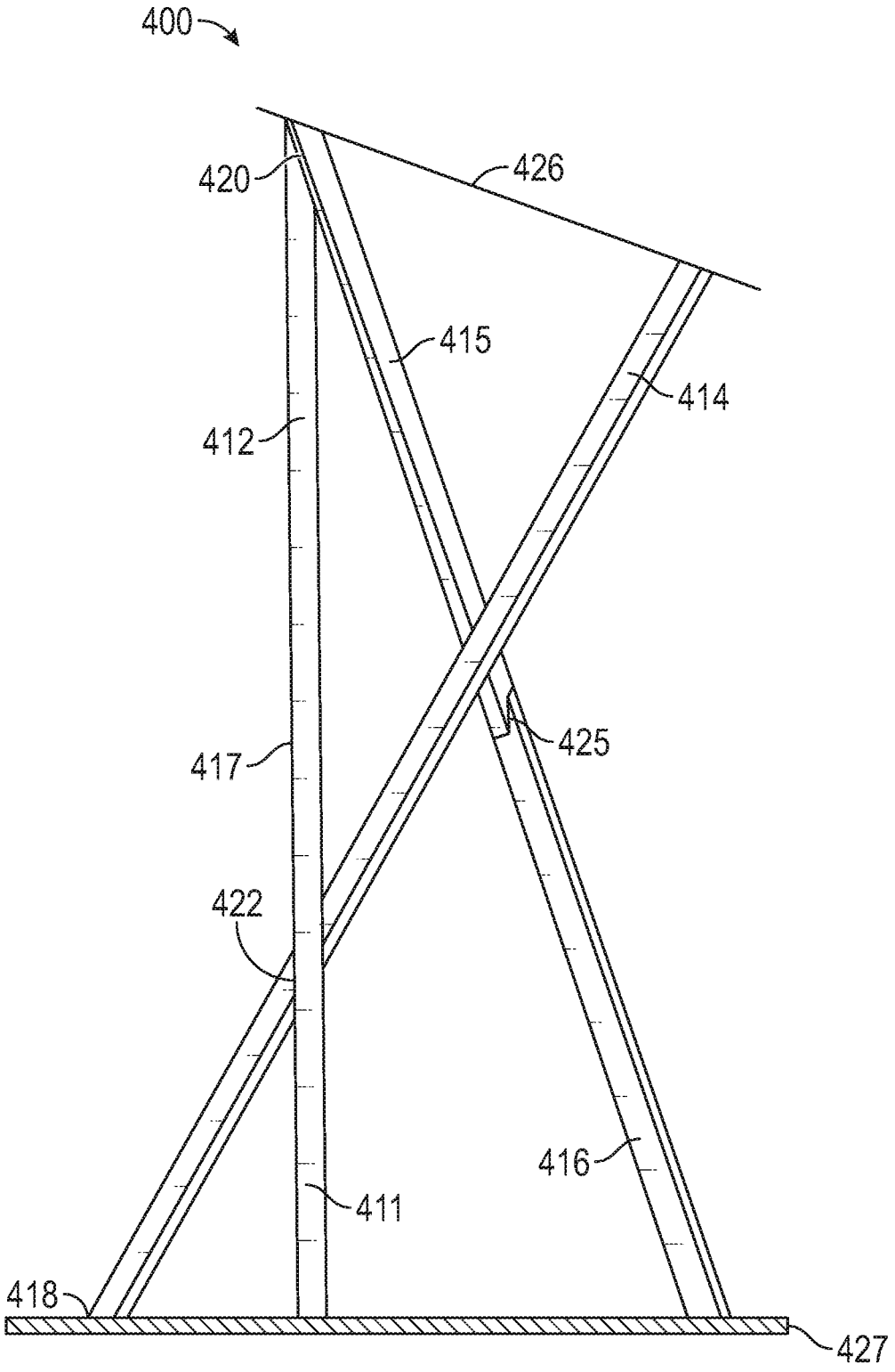
FIG. 11 is a perspective side view of the base in the lectern configuration, according to one example.

FIG. 11 is a left side view of the base 400 in the lectern configuration. In the lectern configuration, base 400 can be configured to rest on a ground surface 427. The base 400 can further be configured to support the lectern surface 426 at an angle relative to the ground surface 427. In some examples, the first beam 411 and the second beam 412 can be perpendicular to the ground surface 427 in the lectern configuration, thereby angling the lectern surface 426 relative to the ground surface 427.

PARTIAL LISTING OF REFERENCE NUMERALS FOR CONVENIENCE

11, 12, 13, 14, 15, 16 construction beams shaped to form base structure

17 joint connecting beam 11 and beam 12

18, 18, 20 joints connecting mitered beams in a "V" configuration

21, 22, 23, 24, 25 joints connecting two beams held at compound angles

22A, 22B detail of mated slidable joinery

19A, 19B detail of joinery at beam termination

26A, 26B opposite polarity ring magnet

27 steel pin connector incorporated in magnetic fastener

Operation

In operation one assembles beam 11 and 12 by pressing together mated joinery forming a rigid 'X' shape between beams, completed at joint 17. Beam 13 and 14 can slidably connect to beam 11 and 12 respectively, along the cutout planes of joint 21 and 22 shaped into each respective beam. A 'V' shape is thereby formed between the terminal intersection of beam 13 and 14. This 'V' shape is fastened magnetically causing an audible 'click' between surfaces when alignment is complete at joint 18. Beam 15 can then be slidably joined to beam 14 along cutout planes at joint 24. Joint 24 is completed when the 'V' shape formed between beam 11 and 15 is aligned and connected by magnetic fasteners at joint 20. A slight outward pressure against the inner terminal connection between beams at each 'V' joint may be necessary to allow clearance between the protruding steel pin and the mating surface of the corresponding beam. Again, an audible 'click' is heard when joinery and fasteners are connected and aligned. Lastly, beam 16 is slidably connected contiguously with beam 12, 13, and 15. Again, a slight outward pressure may be applied between the confluence of beam 12 and 16 where magnetic fasteners are utilized, aligning joint 19, 23, and 25. A final 'click' sound affirms connection between beams forming the complete base structure. Disassembly reverses the assemble steps.

A rigid horizontal surface using appropriate material, size, shape, and attachment means may then be utilized and supported by the base of FIG. 1. In this iteration the base may be flipped so that the supported surfaces contacting opposite horizontal planes are reversed, allowing more flexibility in use. Disassembly can be achieved by reversing each step of assembly allowing for moving or storage without need for tools.

(1) The base of FIG. 1 is sizable, allowing for changes of use and purpose, by alteration of physical dimensions, materials, fastener type, or angular topology, while maintaining pentagonal topology. (2) The base of FIG. 1 may be used in modular groups along horizontal planes as a means to provide support of a rigid surface larger than the capacity of a single base structure. (3) The base of FIG. 1 may be used in modular groups creating a vertical structure connecting pentagonal forms topologically into a complex structure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

The invention claimed is:

1. A base comprising:

a first beam;

a second beam configured to define a cross half-lap joint with the first beam, wherein the cross half-lap joint bisects the first beam and bisects the second beam;

a third beam configured to define a first compound lap joint with the first beam;

a fourth beam configured to define a second compound lap joint with the second beam and configured to define a first compound miter joint with the third beam;

a fifth beam configured to define a third compound lap joint with the fourth beam and configured to define a second compound miter joint with the first beam; and a sixth beam configured to define a fourth compound lap joint with the third beam, configured to define a fifth compound lap joint with the fifth beam, and configured to define a third compound miter joint with the second beam.

2. The base of claim 1, wherein the base is configured to support a rigid horizontal surface.

3. The base of claim 1, wherein the base forms a pentagonal topology.

4. The base of claim 1, wherein the base further comprises a first pair of ring magnet fasteners and a first metal pin configured to connect the third beam and the fourth beam at the first compound miter joint.

5. The base of claim 1, wherein the base further comprises a second pair of ring magnet fasteners and a second metal pin configured to connect the first beam and the fifth beam at the second compound miter joint.

6. The base of claim 1, wherein the base further comprises a third pair of ring magnet fasteners and a third metal pin configured to connect the second beam and the sixth beam at the third compound miter joint.

7. The base of claim 1, wherein the first beam, the second beam, the third beam, the fourth beam, the fifth beam, and the sixth beam are of the same length.

8. The base of claim 1, wherein the base is configured to rest on a ground surface, wherein the base is configured to support a lectern surface angled relative to the ground surface, and wherein the first beam and the second beam are configured to define a perpendicular angle with the ground surface.

9. A base comprising:

a first beam;

a second beam configured to slidably connect at a first angle to the first beam at a first joint;

a third beam configured to slidably connect at a second angle to the first beam at a second joint;

a fourth beam configured to slidably connect at a third angle to the second beam at a third joint;

a fifth beam configured to slidably connect at a fourth angle to the fourth beam at a fourth joint; and a sixth beam configured to slidably connect at a fifth angle to the third beam and slidably connect at a sixth angle to the fifth beam at a fifth joint.

10. The base of claim 9, wherein the first beam and the second beam slidingly connect at a perpendicular cross half-lap joint, and wherein the first angle is a right angle.

11. The base of claim 9, wherein the first beam and the second beam slidingly connect at an angled cross half-lap joint, and wherein the first angle is not a right angle.

12. The base of claim 9, wherein the second angle, the third angle, the fourth angle, the fifth angle, and the sixth angle are compound angles.

13. The base of claim 9, wherein the third beam is further configured to be fastened to the fourth beam.

14. The base of claim 13, wherein the base further comprises a first pair of magnetic fasteners configured to fasten the third beam to the fourth beam.

15. The base of claim 9, wherein the second beam is further configured to be fastened to the sixth beam.

16. The base of claim 15, wherein the base further comprises a second pair of magnetic fasteners configured to fasten the second beam to the sixth beam.

17. The base of claim 9, wherein the first beam is further configured to be fastened to the fifth beam.

18. The base of claim 17, wherein the base further comprises a third pair of magnetic fasteners configured to fasten the first beam to the fifth beam.

19. A method of assembling a base, comprising:

mating a first beam and a second beam in an X-shape;

slidably connecting a third beam to the first beam;

slidably connecting a fourth beam to the second beam;

slidably connecting a fifth beam to the fourth beam;

connecting the fourth beam to the third beam with magnetic fasteners;

slidably connecting a fifth beam to the fourth beam;

connecting the fifth beam to the first beam with magnetic fasteners;

slidably connecting a sixth beam to the third beam and the fifth beam; and connecting the sixth beam to the second beam with magnetic fasteners.

20. The method of claim 19, wherein the method can be performed without the use of tools.

21. A base comprising:

a cross half-lap joint formed by a first beam and a second beam;

a first compound edge lap joint formed by the first beam and a third beam;

a second compound edge lap joint formed by the second beam and a fourth beam;

a third compound edge lap joint formed by the fourth beam and a fifth beam;

a fourth compound edge lap joint formed by the third beam and a sixth beam;

a fifth compound edge lap joint formed by the fifth beam and the sixth beam;

a first compound miter joint formed by the first beam and the fifth beam;

a second compound miter joint formed by the second beam and the sixth beam; and a third compound miter joint formed by the third beam and the fourth beam.

22. A base comprising a plurality of interlocking beams, wherein each of the plurality of interlocking beams is configured to contact three adjacent beams, wherein the interlocking beam defines a corresponding joint with each of the three adjacent beams, and wherein the corresponding joints are spaced apart from each other.

* * * * *